US010926545B2

(12) United States Patent
Tanabe

(10) Patent No.: US 10,926,545 B2
(45) Date of Patent: Feb. 23, 2021

(54) LIQUID SUPPLYING SYSTEM INCLUDING CARTRIDGE AND TANK HAVING AIR COMMUNICATION PORT COVERED WITH SEMIPERMEABLE MEMBRANE

(71) Applicant: BROTHER KOGYO KABUSHIKI KAISHA, Nagoya (JP)

(72) Inventor: Yuma Tanabe, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/297,845

(22) Filed: Mar. 11, 2019

(65) Prior Publication Data

US 2019/0299636 A1 Oct. 3, 2019

(30) Foreign Application Priority Data

Mar. 30, 2018 (JP) ..... JP2018-067572

(51) Int. Cl.
*B41J 2/175* (2006.01)

(52) U.S. Cl.
CPC ..... *B41J 2/175* (2013.01); *B41J 2/1752* (2013.01); *B41J 2/17566* (2013.01); *B41J 2002/17573* (2013.01)

(58) Field of Classification Search
CPC ..... B41J 2/175; B41J 2/17566; B41J 2/1752; B41J 2/17556; B41J 2002/17573; B41J 2002/17576
See application file for complete search history.

(56) References Cited

U.S. PATENT DOCUMENTS

2006/0164478 A1 7/2006 Fukazawa
2020/0070528 A1* 3/2020 Ishibe ..... B41J 2/17553
2020/0070532 A1* 3/2020 Osakabe ..... B41J 2/17553

FOREIGN PATENT DOCUMENTS

JP 2006-205528 A 8/2006

* cited by examiner

*Primary Examiner* — Justin Seo
(74) *Attorney, Agent, or Firm* — Merchant & Gould P.C.

(57) ABSTRACT

A liquid supplying system includes a cartridge and a tank connectable to the cartridge. The cartridge includes a first storage chamber and a first air communication port. The tank includes a second storage chamber, an inlet port, an outlet port, a second air communication port, and a semipermeable membrane. Liquid stored in the first storage chamber of the cartridge connected to the tank is introduced into the second storage chamber through the inlet port and discharged through the outlet port. The semipermeable membrane is provided to cover the second air communication port and allows air to pass therethrough. The semipermeable membrane is positioned below the inlet port.

10 Claims, 6 Drawing Sheets

LIQUID SUPPLYING SYSTEM INCLUDING CARTRIDGE AND TANK HAVING AIR COMMUNICATION PORT COVERED WITH SEMIPERMEABLE MEMBRANE

CROSS REFERENCE TO RELATED APPLICATION

This application claims priority from Japanese Patent Application No. 2018-067572 filed on Mar. 30, 2018. The entire content of the priority application is incorporated herein by reference.

TECHNICAL FIELD

The present disclosure relates to a liquid supplying system in which liquid flows from a cartridge into a tank.

BACKGROUND

Japanese Patent Application Publication No. 2006-205528 discloses a liquid supplying system for supplying liquid from a cartridge into a tank using a so-called chicken feeding scheme. In this system, every time some liquid stored in the tank is consumed, liquid is supplied from the cartridge into the tank so that a certain liquid level can be maintained in the tank.

In the chicken feeding scheme, a tank is located below a cartridge. The tank includes an air communication port in communication with atmosphere. The tank is in communication with the cartridge via an air passage and a liquid passage. When liquid in the tank is consumed and a liquid level therein is lowered to a level below an opening provided at a lower edge of the air passage, air enters the tank through the air communication port and then enters the cartridge through the air passage. As a result, the same amount of liquid as a volume of the air that has entered the cartridge is supplied from the cartridge into the tank through the liquid passage. Liquid supply is stopped when the liquid level in the tank reaches the level of the opening of the air passage. In this way, a certain liquid level is maintained in the tank.

SUMMARY

However, the chicken feeding scheme requires the tank to have a space therein for arranging the air passage and the liquid passage. The chicken feeding scheme also requires that the air passage be provided with the opening located below the air communication port. In the chicken feeding scheme, as described above, the liquid level in the tank is maintained at the level of the opening of the air passage. Accordingly, in the chicken feeding scheme, a space that can store no ink needs to be provided between the opening of the air passage and the air communication port. The tank size is increased by the volume of the space, without increasing a capacity of the tank for storing liquid.

In view of the foregoing, it is an object of the disclosure to provide a liquid supplying system that allows a larger proportion to be occupied as a space for storing liquid in a storage chamber of a tank.

In order to attain the above and other objects, according to one aspect, the disclosure provides a liquid supplying system including a cartridge and a tank. The cartridge includes: a first storage chamber configured to store therein a liquid; and a first air communication port allowing the first storage chamber to communicate with an atmosphere. The tank includes: a second storage chamber configured to store therein the liquid; an inlet port; an outlet port; a second air communication port; and a semipermeable membrane. The liquid stored in the first storage chamber of the cartridge connected to the tank is introduced into the second storage chamber through the inlet port. The liquid stored in the second storage chamber is discharged through the outlet port. The second air communication port allows the second storage chamber to communicate with the atmosphere. The semipermeable membrane is provided to cover the second air communication port and allows air to pass therethrough. The semipermeable membrane is positioned below the inlet port.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
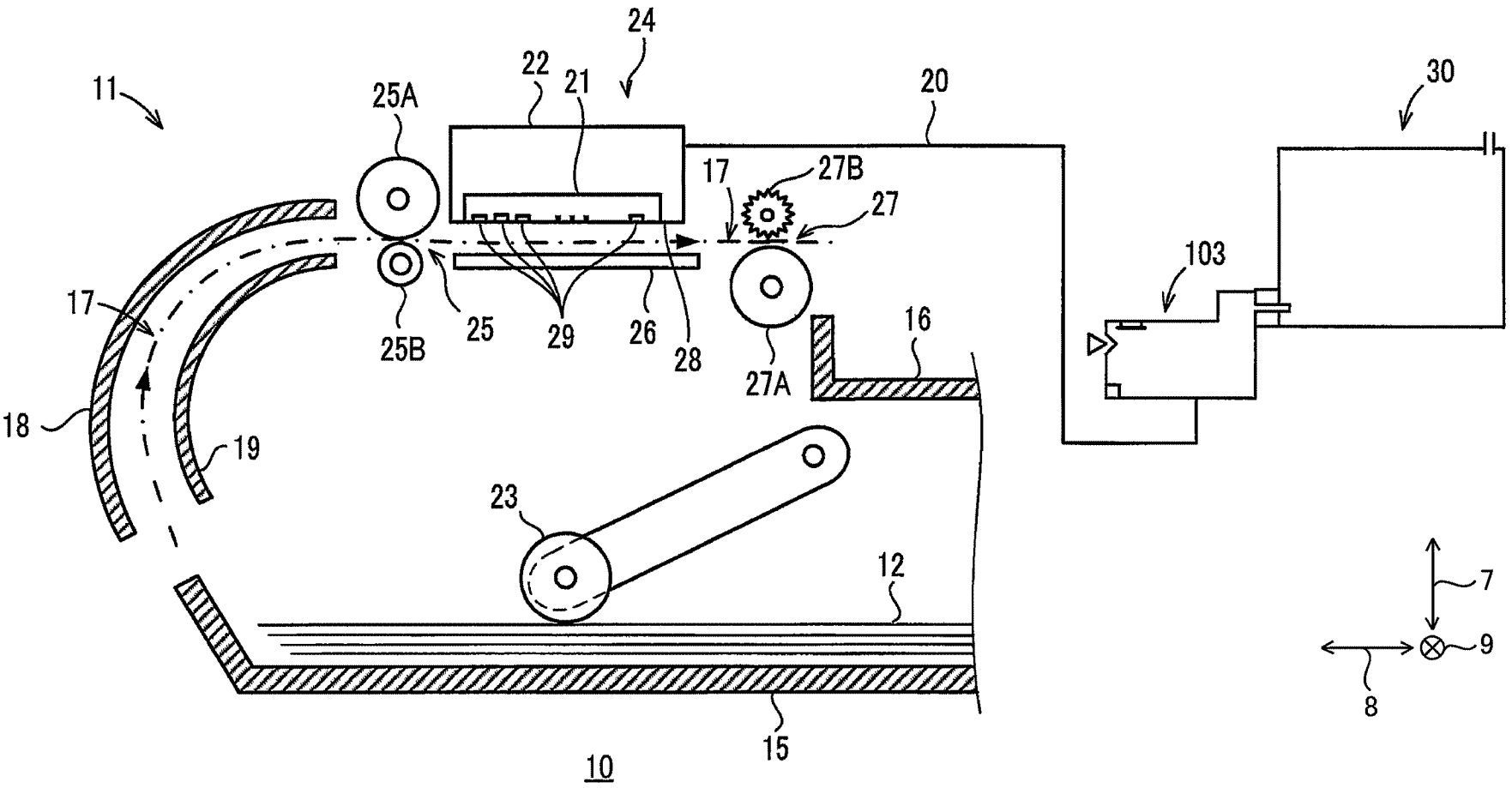
FIG. 1 is a vertical cross-sectional view schematically illustrating an internal configuration of a printer portion of a multifunction peripheral according to one embodiment.

A multifunction peripheral 10 as an example of a system according to one embodiment will be described with reference to the accompanying drawings, wherein like parts and components are designated by the same reference numerals to avoid duplicating description.

In the following description, up, down, front, rear, left, and right directions related to the multifunction peripheral 10 will be referred to assuming that the multifunction peripheral 10 is disposed on a horizontal plane so as to be operable, as shown in FIG. 1A. Note that this posture of the multifunction peripheral 10 illustrated in FIG. 1A will be referred to as an "operable posture". Specifically, an up-down direction 7 of the multifunction peripheral 10 is defined based on the operable posture of the multifunction peripheral 10. A front-rear direction 8 is defined assuming that a direction in which a sheet 12 is conveyed from a feed tray 15 of the multifunction peripheral 10 corresponds to a rearward direction. A left-right direction 9 is defined based on an assumption that the multifunction peripheral 10 in the operable posture is viewed from its front surface. In FIGS. 1 to 6, a direction from a near side toward a far side in each drawing corresponds to a rightward direction.

In the present embodiment, in the operable posture of the multifunction peripheral 10, the up-down direction 7 is parallel to a vertical direction, and the front-rear direction 8 and the left-right direction 9 are parallel to a horizontal direction. Further, the front-rear direction 8 is perpendicular to the left-right direction 9.

[Overall Structure of Multifunction Peripheral 10]

The multifunction peripheral 10 includes a printer portion 11. The printer portion 11 is configured to record an image on each sheet 12 with an inkjet recording method. The multifunction peripheral 10 may also have other functions, such as a facsimile function, a scanning function, and a copying function.

As illustrated in FIG. 1, the printer portion 11 includes the feed tray 15, a discharge tray 16, a feed roller 23, a conveying roller pair 25, a discharge roller pair 27, a recording portion 24, and a platen 26.

<Feed Tray 15, Discharge Tray 16, and Feed Roller 23>

As illustrated in FIG. 1, the feeding tray 15 is configured to support a plurality of sheets 12 in a stacked state.

The discharge tray 16 is disposed above the feed tray 15. The discharge tray 16 is configured to support the sheets 12 discharged by the discharge roller pair 27 through a space between the recording portion 24 and the platen 26.

The feed roller 23 is driven by a feed motor (not illustrated) to feed each of the sheets 12 supported in the feed tray 15 toward a conveying path 17.

<Conveying Path 17>

The conveying path 17 is a space defined mainly by guide members 18, 19, the recording portion 24 and the platen 26. Inside the printer portion 11, the guide members 18 and 19 face each other with a predetermined interval, and the recording portion 24 and the platen 26 face each other with a predetermined gap therebetween. The conveying path 17 extends upward from a rear end portion of the feed tray 15, while making a U-turn toward the front, and passes through a position facing the recording portion 24, and reaches the discharge tray 16. A conveying direction of the sheet 12 along the conveying path 17 is indicated by a dashed-dotted arrow in FIG. 1.

<Conveying Roller Pair 25>

As illustrated in FIG. 1, the conveying roller pair 25 is disposed at the conveying path 17. The conveying roller pair 25 includes a conveying roller 25A and a pinch roller 25B arranged to oppose each other. The conveying roller 25A is configured to be driven by a conveying motor (not shown). The pinch roller 25B is configured to be rotated following rotation of the conveying roller 25A. As the conveying roller 25A is rotated forward in response to forward rotation of the conveying motor, each sheet 12 is nipped between the conveying roller 25A and the pinch roller 25B to be conveyed in the conveying direction.

<Discharge Roller Pair 27>

The discharge roller pair 27 is disposed at the conveying path 17 at a position downstream relative to the conveying roller pair 25 in the conveying direction. The discharge roller pair 27 include a discharge roller 27A and a spur roller 27B arranged to oppose each other. The discharge roller 27A is configured to be driven by the conveying motor (not illustrated). The spur roller 27B is configured to be rotated following rotation of the discharging roller 27A. When the discharge roller 27A is rotated forward in response to the forward rotation of the conveying motor, each sheet 12 is nipped between the discharge roller 27A and the spur roller 27B to be conveyed in the conveying direction.

<Recording Portion 24 and Platen 26>

As illustrated in FIG. 1, the recording portion 24 and the platen 26 are disposed at the conveying path 17 at a position between the conveying roller pair 25 and the discharge roller pair 27 in the conveying direction. Specifically, the recording portion 24 and the platen 26 are positioned downstream of the conveying roller pair 25 and upstream of the discharge roller pair 27 in the conveying direction. The recording portion 24 and the platen 26 are arranged to oppose each other in the up-down direction 7.

The recording portion 24 includes a carriage 22 and a recording head 21 mounted on the carriage 22. The carriage 22 is reciprocally movable in the left-right direction 9 upon transmission of driving force from a drive motor (not illustrated). The recording head 21 has a lower surface 28 at which a plurality of nozzles 29 are formed. The recording head 21 is configured to eject ink droplets through the nozzles 29 by oscillation of the nozzles 29 provided by oscillation elements such as piezoelectric elements. During lateral movements of the carriage 22, ink droplets are selectively ejected from the nozzles 29 onto the sheet 12 supported on the platen 26 to thus form an inked image on the sheet 12.

A bundle of ink tubes 20 and a flexible flat cable (not illustrated) are connected to the carriage 22. Each ink tube 20 connects each of four tanks 103 (described later) to the recording head 21. Specifically, each of the ink tubes 20 is configured to supply ink stored in a corresponding ink cartridge 30 attached to the tank 103 to the recording head 21. In the present embodiment, four ink tubes 20 are provided in one-to-one correspondence with four ink cartridges 30 attachable to the tanks 103, so that ink of four colors (black, magenta, cyan, and yellow) stored in the respective four ink cartridges 30 can flow through the corresponding ink tubes 20. These ink tubes 20 are bundled and connected to the recording head 21. The flexible flat cable is configured to electrically connect the recording head 21 to a control board (not illustrated) of the multifunction peripheral 10. The control board is configured to control operations of the multifunction peripheral 10.

<Tanks 103>

Each of the four tanks 103 is configured to store ink of one of four colors supplied from the corresponding one of the four ink cartridges 30.

In the following description, for simplifying description, only one of the four tanks 103 will be described in details, since the four tanks 103 have the same configurations as one another.

Figure 2:
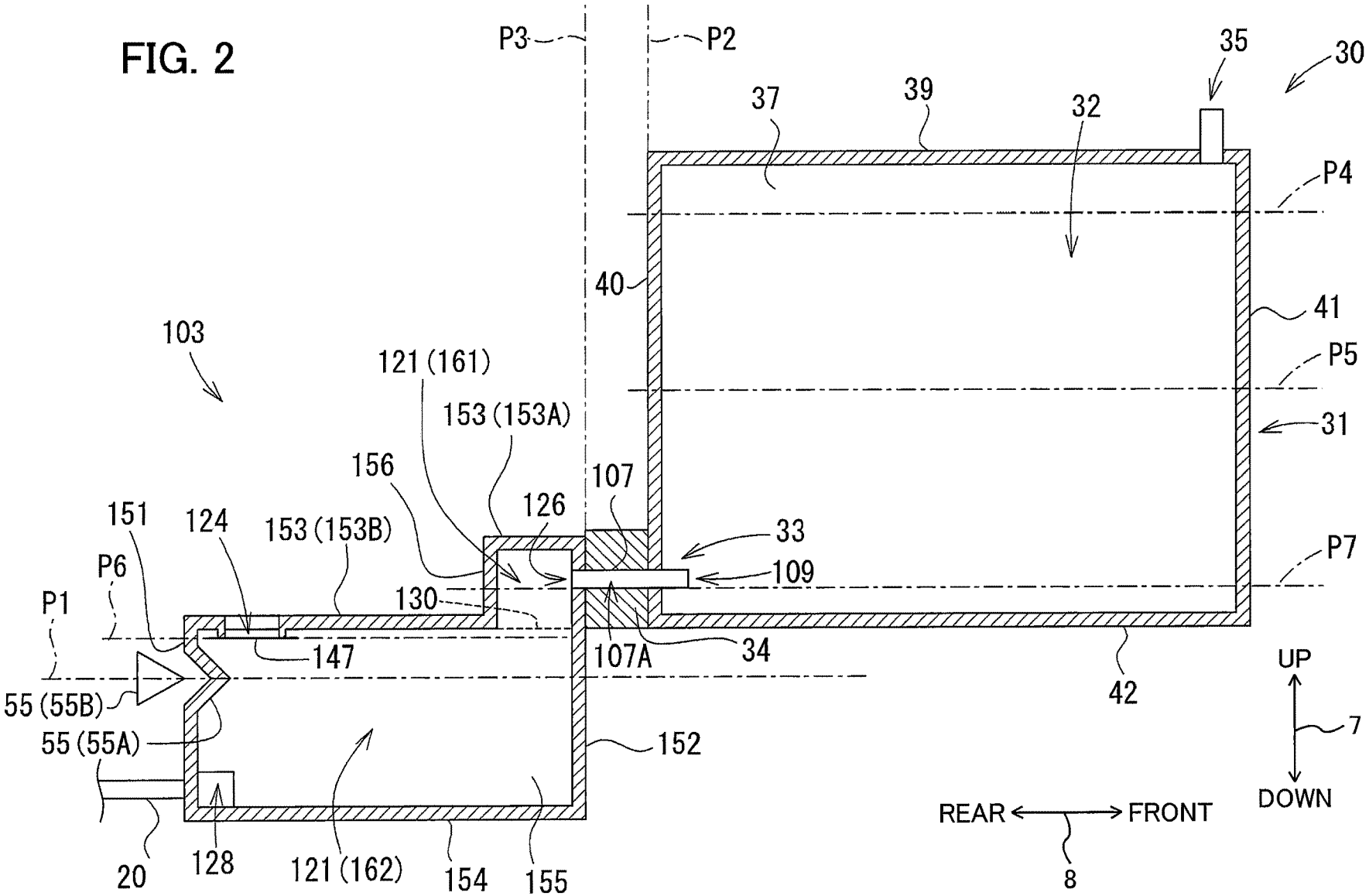
FIG. 2 is a vertical cross-sectional view schematically illustrating a state in which a cartridge and a tank of the printer portion are connected to each other according to the embodiment.

As illustrated in FIG. 2, the tank 103 has a box shape and defines therein a storage chamber 121 for storing ink. The tank 103 includes a rear wall 151, a front wall 152, an upper wall 153, a lower wall 154, a step wall 156, and a pair of side walls 155 facing each other in the left-right direction 9.

The upper wall 153 includes a first upper wall 153A and a second upper wall 153B. The first upper wall 153A extends rearward from an upper end of the front wall 152. The second upper wall 153B is positioned below and rearward of the first upper wall 153A and extends forward from an upper end of the rear wall 151. The step wall 156 is a wall extending in the up-down direction 7 and the left-right direction 9 to connect a rear end of the first upper wall 153A to a front end of the second upper wall 153B.

The storage chamber 121 is a space defined by the rear wall 151, the front wall 152, the upper wall 153, the step wall 156, the lower wall 154, and the pair of side walls 155. The storage chamber 121 includes a first section 161 and a second section 162 located below the first section 161.

The first section 161 is a portion of the storage chamber 121 positioned above a broken line 130 depicted in FIG. 2. Specifically, the first section 161 is defined by an upper portion of the front wall 152, the first upper wall 153A, the step wall 156, and upper portions of the respective side walls 155.

The second section 162 is a portion of the storage chamber 121 positioned below the broken line 130 depicted in FIG. 2. Specifically, the second section 162 is defined by the rear wall 151, a lower portion of the front wall 152, the second upper wall 153B, the lower wall 154, and lower portions of the respective side walls 155.

The rear wall 151 and the front wall 152 define a distance therebetween that is greater than a distance defined between the step wall 156 and the front wall 152 in the front-rear direction 8. Hence, the second section 162 provides a horizontal cross-sectional area (i.e., an area of a virtual horizontal plane enclosed by the rear wall 151, the front wall 152, and the pair of side walls 155 as viewed in the up-down direction 7) that is greater than a horizontal cross-sectional area of the first section 161 (i.e., an area of a virtual horizontal plane enclosed by the step wall 156, the front wall 152, and the pair of side walls 155 as viewed in the up-down direction 7).

The second section 162 of the storage chamber 121 is in communication with the corresponding ink tube 20 through an outlet port 128. The outlet port 128 is provided in the vicinity of the lower wall 154 that defines a bottom edge of the storage chamber 121. Accordingly, the second section 162 is provided with the outlet port 128. The outlet port 128 is positioned below a connecting pipe 107 (described later). Ink stored in the storage chamber 121 flows out through the outlet port 128 and is supplied to the recording head 21 through the corresponding ink tube 20.

The second upper wall 153B is formed with a communication port 124. The communication port 124 penetrates through the second upper wall 153B in the up-down direction 7. A semipermeable membrane 147 is provided to cover the communication port 124 for closing the communication port 124. That is, the semipermeable membrane 147 is provided within the second section 162. Specifically, the semipermeable membrane 147 is provided to cover the communication port 124 such that both surfaces (upper and lower surfaces) of the semipermeable membrane 147 are orthogonal to the up-down direction 7. Thus, the surface of the semipermeable membrane 147 facing the second section 162 (i.e., the bottom surface) faces downward, whereas the upper surface of the semipermeable membrane 147 (the surface opposite to the bottom surface) faces upward. The semipermeable membrane 147 prevents ink to flow therethrough, but allows air flow therethrough. Hence, the second section 162 of the storage chamber 121 is in communication with the outside of the tank 103 (atmosphere) through the communication port 124 and the semipermeable membrane 147, whereas the ink in the second section 162 is prevented from flowing out therefrom through the communication port 124 and the semipermeable membrane 147.

The rear wall 151 has a portion 55A that faces a light emitter 55B of a liquid-level sensor 55 (described later) in the front-rear direction 8. Of the walls constituting the tank 103, this portion 55A of the rear wall 151 is at least light transmissive so that light emitted from the light emitter 55B can pass through the portion 55A. This portion 55A of the rear wall 151 serves as a prism 55A constituting the liquid-level sensor 55.

<Connecting Pipe 107>

As depicted in FIG. 2, the connecting pipe 107 is also provided at the tank 103. The connecting pipe 107 extends forward from a portion of the front wall 152, the portion facing the step wall 156 in the front-rear direction 8 (i.e., a portion of the front wall 152 higher than the second upper wall 153B). That is, the connecting pipe 107 extends in the front-rear direction 8. The connecting pipe 107 is arranged at a position corresponding to a position of an ink supply portion 34 (described later) of the ink cartridge 30 attached to the tank 103. The connecting pipe 107 is positioned higher than the outlet port 128 in the up-down direction 7.

The connecting pipe 107 is a tubular member made of a resin. The connecting pipe 107 defines an internal space 107A therein. The connecting pipe 107 has a protruding end (front end) formed with an opening 109 in communication with the internal space 107A. An inlet port 126 is formed at the portion of the front wall 152 facing the step wall 156 in the front-rear direction 8. Accordingly, the first section 161 is provided with the inlet port 126. The inlet port 126 is positioned higher than the semipermeable membrane 147, the communication port 124, and the outlet port 128 in the up-down direction 7. The inlet port 126 provides communication between the internal space 107A of the connecting pipe 107 and the first section 161 of the storage chamber 121.

<Liquid-Level Sensor 55>

The liquid-level sensor 55 is configured to detect whether a level of ink stored in the storage chamber 121 reaches a predetermined position P1 (indicated in FIG. 2). The liquid-level sensor 55 makes use of the prism 55A which provides an optical reflectivity that varies depending on whether the ink in the storage chamber 121 is in contact with the prism 55A.

As illustrated in FIG. 2, the predetermined position P1 is below the semipermeable membrane 147 and above the outlet port 128 in the up-down direction 7. In the present embodiment, the predetermined position P1 is positioned within the second section 162 of the storage chamber 121 in the tank 103 in the up-down direction 7. Accordingly, the liquid-level sensor 55 is configured to detect the level of the ink stored in the second section 162 of the storage chamber 121.

The liquid-level sensor 55 includes the prism 55A, the light emitter 55B, and a light receiver (not illustrated). In the rear wall 151 defining the second section 162 of the storage chamber 121, a portion positioned at and in the vicinity of the predetermined position P1 constitutes the prism 55A. The light emitter 55B and the light receiver are positioned rearward of the prism 55A to face the prism 55A in the front-rear direction 8. The light emitter 55B is configured to emit light toward the prism 55A. The light receiver is configured to receive the light emitted from the light emitter 55B and then reflected by the prism 55A. The light receiver is configured to output a signal based on an intensity of the received light to the control board (not illustrated) of the multifunction peripheral 10.

When the level of the ink stored in the storage chamber 121 is above the predetermined position P1, the ink is in contact with the prism 55A on a path of the light emitted from the light emitter 55B. In this situation, the light emitted from the light emitter 55B to the prism 55A enters the storage chamber 121 through the prism 55A and is absorbed by the ink in the storage chamber 121 without being reflected by the prism 55A. The light emitted from the light emitter 55B thus does not reach the light receiver. Accordingly, the light receiver outputs a low-level signal to the control board of the multifunction peripheral 10. On the other hand, when the level of the ink stored in the storage chamber 121 is at or below the predetermined position P1, the ink is not in contact with the prism 55A on the path of the light emitted from the light emitter 55B. In this situation, the light emitted from the light emitter 55B to the prism 55A is reflected by the prism 55A and is received by the light receiver. The light receiver hence outputs a high-level signal to the control board of the multifunction peripheral 10.

Upon receipt of the high-level signal from the liquid-level sensor 55 after receiving the low-level signal, the control board (or a controller mounted on the control board) may issue a notification that ink stored in the ink cartridge 30 can no longer be supplied to the tank 103, for example. The notification may be made, for example, by means of displaying a warning message on a display of the multifunction peripheral 10. In this way, the control board is configured to determine whether the ink stored in the ink cartridge 30 can still be supplied to the tank 103 on a basis of a residual amount of ink in the storage chamber 121 of the tank 103.

[Ink Cartridge 30]

The ink cartridge 30 is a container storing ink therein. As depicted in FIG. 2, the ink cartridge 30 includes a housing 31 and the ink supply portion 34. The housing 31 has a substantially rectangular parallelepiped shape. Note that the ink cartridges 30 storing ink of different colors may have the same outer shape as one another, or may have different outer shapes from one another.

The housing 31 includes a rear wall 40, a front wall 41, an upper wall 39, a lower wall 42, and a pair of side walls 37 facing each other in the left-right direction 9. The housing 31 defines an internal space therein. This internal space of the housing 31 serves as a storage chamber 32 for storing ink therein.

The ink supply portion 34 protrudes rearward from a lower end portion of the rear wall 40. The ink supply portion 34 has a hollow cylindrical shape. The ink supply portion 34 has an internal space therein that is in communication with the storage chamber 32 through an outlet port 33 formed in the rear wall 40. The outlet port 33 penetrates through the rear wall 40 in the front-rear direction 8. The ink supply portion 34 has a protruding end (open rear end) that is open to the outside of the ink cartridge 30. Although not illustrated in the drawings, the open protruding end of the ink supply portion 34 may be closed by a seal or a valve so that the protruding end can be opened when the ink cartridge 30 is used.

The upper wall 39 is formed with a communication port 35. The communication port 35 penetrates through the upper wall 39 of the housing 31 in the up-down direction 7. The communication port 35 provides communication between the storage chamber 32 and the outside of the ink cartridge 30 (atmosphere). The communication port 35 may be sealed with a semipermeable membrane.

As depicted in FIG. 2, the ink cartridge 30 is connectable to the corresponding tank 103 from a front side thereof. In particular, the connecting pipe 107 of the tank 103 is inserted into the internal space of the ink supply portion 34 of the ink cartridge 30 from a rear side thereof so that the ink supply portion 34 of the ink cartridge 30 is connected to the connecting pipe 107 of the tank 103. The ink cartridge 30 is thus connected to the connecting pipe 107 in the front-rear direction 8.

Referring to FIG. 2, in a state where the ink cartridge 30 is connected to the tank 103, the ink cartridge 30 defines a position P2 corresponding to a rearmost end of the housing 31 of the ink cartridge 30 in the front-rear direction 8, whereas the tank 103 defines a position P3 corresponding to a frontmost end of the tank 103 in the front-rear direction 8. In this state where the ink cartridge 30 is connected to the tank 103, the position P2 defined by the ink cartridge 30 is located forward relative to the position P3 defined by the tank 103 in the front-rear direction 8. That is, the ink cartridge 30 and the tank 103 do not overlap each other when viewed in the up-down direction 7. Put different way, in the state where the ink cartridge 30 is connected to the tank 103, the ink cartridge 30 is positioned offset from the tank 103 in the up-down direction 7. To be more specific, the ink cartridge 30 (excluding the ink supply portion 34) and the tank 103 (excluding the connecting pipe 107) are positioned offset from each other in the up-down direction 7 in the state where the ink cartridge 30 is connected to the tank 103.

The posture of the multifunction peripheral 10 depicted in FIGS. 1 and 2 is the operable posture. The multifunction peripheral 10 is configured to perform various operations such as image recording operations in the operable posture. Hereinafter, an operation for mounting the new ink cartridge 30 in the unused (new) multifunction peripheral 10 will be described.

In a brand-new state, the storage chamber 32 of the ink cartridge 30 is filled with ink to capacity. No ink is available in the storage chamber 121 of the tank 103 of the multifunction peripheral 10 in a brand-new state. Here, 'no ink in the storage chamber 121' denotes a state that ink has not yet flown out of the ink cartridge 30 into the storage chamber 121. Note that, during a manufacturing process of the multifunction peripheral 10, some ink may be temporarily stored in the storage chamber 121 for an inspection and then removed from the storage chamber 121 after the inspection. Such ink residue in the storage chamber 121 (ink that was left over from the inspection) is not deemed as ink stored in the storage chamber 121 in the present embodiment.

In FIG. 2, a position P4 (indicated by a dotted-dashed line) represents a level of ink stored in the storage chamber 32 of the brand-new ink cartridge 30 that has just been mounted in the new multifunction peripheral 10. That is, the position P4 represents the level of the ink stored in the brand-new ink cartridge 30 in the up-down direction 7 in a state where ink in the ink cartridge 30 has not yet flown into the storage chamber 121 of the tank 103 of the unused multifunction peripheral 10.

When the ink cartridge 30 is mounted in a cartridge receiving portion (not shown) of the multifunction peripheral 10 and is connected to the tank 103, as depicted in FIG. 2, the storage chamber 32 of the ink cartridge 30 is made to communicate with the internal space 107A of the connecting pipe 107 through the opening 109. Also, the internal space 107A of the connecting pipe 107 is made to communicate with the storage chamber 121 of the tank 103 through the inlet port 126.

Since there is no ink in the storage chamber 121 at the time of connection of the ink cartridge 30 to the tank 103, the storage chamber 121 is in communication with the outside of the tank 103 (ambient air) through the communication port 124 and the semipermeable membrane 147. Accordingly, due to hydraulic head difference, the ink stored in the storage chamber 32 of the ink cartridge 30 flows into the storage chamber 121 through the internal space 107A of the connecting pipe 107 connected to the ink cartridge 30. As the ink flows into the storage chamber 121 from the storage chamber 32, a volume of ink stored in the storage chamber 121 increases. As much air as is equal to an amount of the increase in the ink volume moves from the storage chamber 121 to the outside of the tank 103 through the semipermeable membrane 147 and the communication port 124, thereby decreasing a volume of air within the storage chamber 121. That is, gas-liquid substitution occurs in the storage chamber 121.

The above-described circulation of ink from the storage chamber 32 into the storage chamber 121 caused by hydraulic head difference raises the level of the ink stored in the storage chamber 121. The level of the ink stored in the storage chamber 32 is eventually lowered to a position P5 (indicated by a dotted-dashed line in FIG. 2), while the level of the ink stored in the storage chamber 121 reaches a position P6 (i.e., at the same height as the semipermeable membrane 147). In a state where the level of ink in the storage chamber 121 is at the position P6, an entirety of the bottom surface of the semipermeable membrane 147 is immersed in the ink. Hence, the communication port 124 is sealed with the ink stored in the storage chamber 121, and the storage chamber 121 is closed off from the outside of the tank 103 (atmosphere). As a result, the air remaining in the storage chamber 121 (in particular, the air remaining in a portion of the second section 162 above the semipermeable membrane 147 and the air remaining in the first section 161) cannot go out of the tank 103. Thus, gas-liquid substitution can no longer occur in the storage chamber 121, thereby stopping circulation of the ink stored in the storage chamber 32 into the storage chamber 121 due to hydraulic head difference.

As the ink is discharged from the recording head 21, the ink stored in the storage chamber 121 flows into the recording head 21 through the outlet port 128. As a result, the level of the ink stored in the storage chamber 121 falls down from the position P6, thereby separating the lower surface of the semipermeable membrane 147 from the surface of the ink in the storage chamber 121. The storage chamber 121 is hence allowed to communicate with the outside of the tank 103 (atmosphere) again through the communication port 124 and the semipermeable membrane 147. Consequently, ink stored in the storage chamber 32 is again caused to flow into the storage chamber 121 due to hydraulic head difference. The circulation of ink from the storage chamber 32 into the storage chamber 121 stops when the level of the ink stored in the storage chamber 121 rises up to the position P6. Thereafter, every time the level of the ink stored in the storage chamber 121 becomes lower than the position P6 as a result of discharging of ink from the recording head 21, as much ink as is equal to the amount of the ink decrease in the storage chamber 121 is supplied from the storage chamber 32. Therefore, as ink is discharged from the recording head 21, the level of the ink stored in the storage chamber 121 is maintained at the position P6, while the level of the ink stored in the storage chamber 32 drops.

When the level of the ink stored in the storage chamber 32 is lowered to a position below the internal space 107A of the connecting pipe 107, i.e., when the level of ink in the storage chamber 32 reaches a position P7 depicted in FIG. 2, the ink flow from the storage chamber 32 into the storage chamber 121 is terminated. Meanwhile, the storage chamber 121 is made to communicate with the outside of the tank 103 (atmosphere) through the internal space 107A, the storage chamber 32, and the communication port 35. When ink is discharged from the recording head 21 thereafter, ink stored in the storage chamber 121 is consumed, and the ink level in the storage chamber 121 falls down from the position P6.

When the level of the ink stored in the storage chamber 121 is lowered to the predetermined position P1, light emitted from the light emitter 55B of the liquid-level sensor 55 to the prism 55A is reflected by the prism 55A and received by the light receiver. The light receiver hence outputs a high-level signal to the control board (not shown) of the multifunction peripheral 10. Upon receipt of the high-level signal from the light receiver of the liquid-level sensor 55, the control board (the controller mounted on the control board) may, for example, issue a notification to inform the user that the ink in the storage chamber 32 of the ink cartridge 30 can no longer be supplied to the tank 103.

Operational and Technical Advantages of the Embodiment

In the present embodiment, in a state where the semipermeable membrane 147 is not soaked in ink, the storage chamber 121 of the tank 103 is in communication with atmosphere through the communication port 124. Hence, when the ink cartridge 30 is connected to the tank 103, the ink stored in the storage chamber 32 of the ink cartridge 30 can be supplied into the storage chamber 121 of the tank 103.

In the embodiment, as long as the semipermeable membrane 147 is immersed in ink, the storage chamber 121 is shut off from communicating with atmosphere, while the storage chamber 32 of the ink cartridge 30 is in communication with atmosphere through the communication port 35. In this situation, when ink is supplied from the storage chamber 121 to the recording part 24, atmosphere that would compensate for the decrease in the volume of the ink stored in the storage chamber 121 cannot be introduced into the storage chamber 121 (gas-liquid substitution cannot occur), since the storage chamber 121 is isolated from the atmosphere. Hence, ink is supplied into the storage chamber 121 from the storage chamber 32 that is in communication with air (since gas-liquid substitution can occur in the storage chamber 32). Accordingly, the liquid level is maintained at the position P6 in the storage chamber 121, while the liquid level in the storage chamber 32 is decreased. That is, the ink stored in the storage chamber 32 of the ink cartridge 30 can be consumed before the ink stored in the storage chamber 121 of the tank 103 is consumed.

According to the configuration of the embodiment, unlike the conventional chicken feeding scheme, an air passage and a liquid passage do not need to be disposed above the semipermeable membrane 147 within the storage chamber 121. Accordingly, the tank 103 can be downsized, and a large proportion of the storage chamber 121 can be used as a space for storing ink.

If the lower surface of the semipermeable membrane 147 facing the storage chamber 121 is arranged not to face downward but to face horizontally, a larger portion of the surface of the semipermeable membrane 147 facing the storage chamber 121 would be soaked in ink, as the level of the ink stored in the storage chamber 121 becomes higher. Hence, as the level of the ink stored in the storage chamber 121 becomes higher, higher resistance would be applied to air circulation through the communication port 124, thereby lowering a rate of ink supply from the storage chamber 32 into the storage chamber 121.

In the present embodiment, however, the surface of the semipermeable membrane 147 facing the storage chamber 121 faces downward. Hence, the surface of the semipermeable membrane 147 facing the storage chamber 121 (i.e., the lower surface of the semipermeable membrane 147) would assume one of the following two states: an entirety of the surface is immersed in ink; or none of the surface is immersed in ink. Accordingly, irrespective of the level of the ink stored in the storage chamber 121, the resistance applied to the air circulation through the communication port 124 can be maintained at a minimum until the semipermeable membrane 147 is soaked in ink. As a result, the ink supply from the storage chamber 32 into the storage chamber 121 can be maintained at a high rate.

In the embodiment, the amount of the ink left in the storage chamber 32 of the ink cartridge 30 is determined by the liquid-level sensor 55 detecting the level of the ink stored in the storage chamber 121 of the tank 103. Hence, there is no need to provide a liquid-level sensor in the storage chamber 32 of the ink cartridge 30. This confirmation of the embodiment thus enables a larger amount of ink to be stored in the storage chamber 32 than otherwise.

In the embodiment, the ink stored in the storage chamber 32 of the ink cartridge 30 can be consumed before the ink stored in the storage chamber 121 of the tank 103 is consumed. Hence, this configuration of the embodiment can reliably detect that there is no ink that can be supplied from the storage chamber 32 to the storage chamber 121, even though the liquid-level sensor 55 is arranged at the storage chamber 121, rather than at the storage chamber 32.

In the embodiment, the predetermined position P1 is below the semipermeable membrane 147. Hence, through the detection by the liquid-level sensor 55, ink empty in the ink cartridge 30 (no ink can be supplied from the storage chamber 32 of the ink cartridge 30 to the storage chamber 121 of the tank 103) can be determined.

In the storage chamber 121 of the depicted embodiment, ink is stored in the second section 162 whose horizontal cross-sectional area is greater than that of the first section 161. Hence, this construction can provide a larger proportion of space for storing ink in the storage chamber 121.

In the embodiment, no ink is stored in the first section 161 of the storage chamber 121. Hence, backflow of ink from the first section 161 into the storage chamber 32 can be restrained.

[Modifications and Variations]

While the description has been made in detail with reference to the embodiment thereof, it would be apparent to those skilled in the art that many modifications and variations may be made therein without departing from the scope of the disclosure.

<First Modification>

In the embodiment described above, the surface of the semipermeable membrane 147 facing the second section 162 (lower surface) faces downward. However, the surface of the semipermeable membrane 147 may face in other directions.

Figure 3:
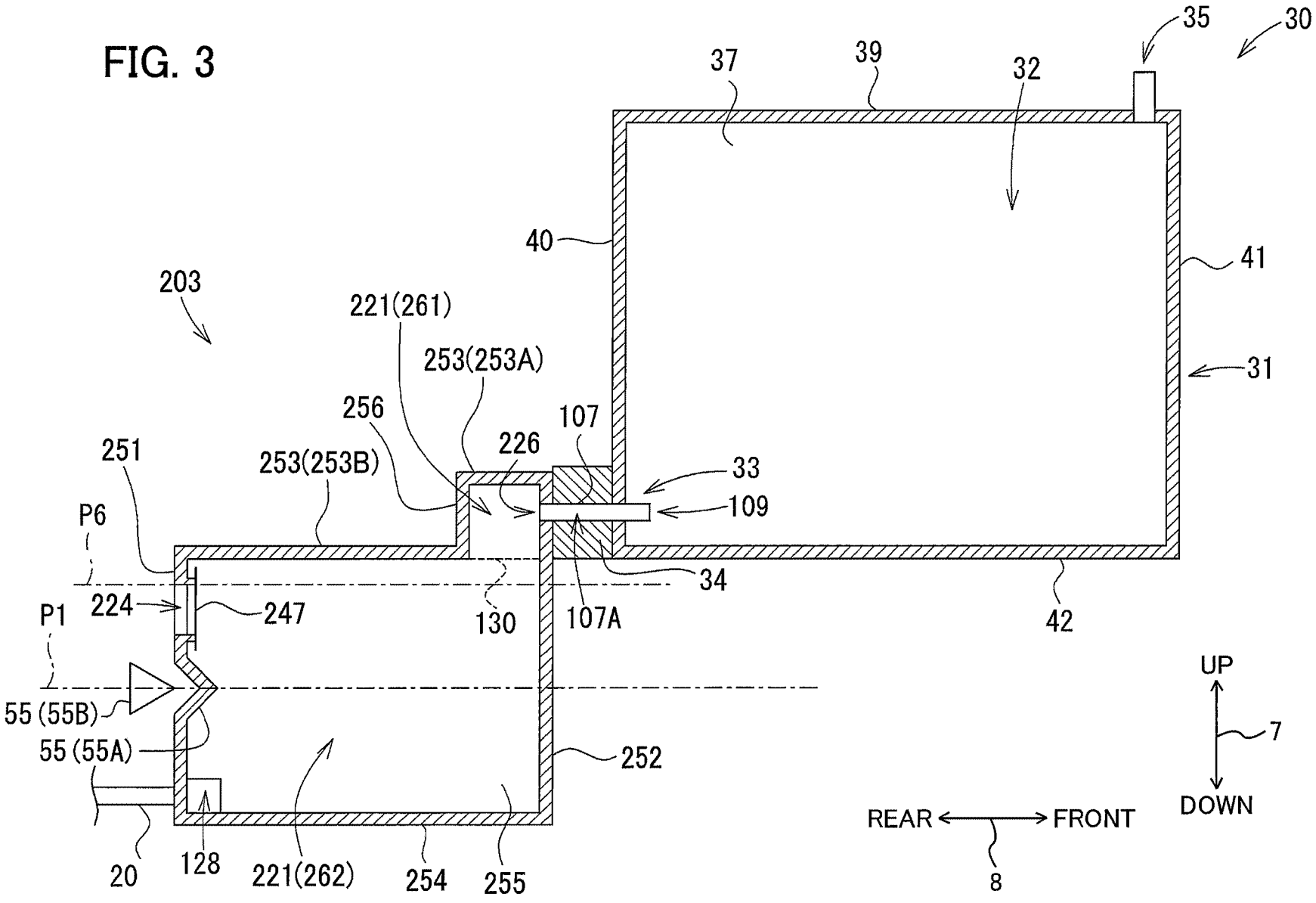
FIG. 3 is a vertical cross-sectional view schematically illustrating a state in which a cartridge and a tank according to a first modification to the embodiment are connected to each other.

As an example, FIG. 3 depicts a tank 203 according to a first modification to the embodiment. This tank 203 of the first modification defines a storage chamber 221 therein. The storage chamber 221 includes a first section 261 and a second section 262 below the first section 261. The first section 261 is defined by a step wall 256, an upper wall 253 (first upper wall 253A), a front wall 252, and a pair of side walls 255. The second section 262 is defined by a second upper wall 253B of the upper wall 253, a rear wall 251, a lower wall 254, the front wall 252, and the pair of side walls 255. The first section 261 is in communication with the internal space 107A of the connecting pipe 107 through an inlet port 226 formed in the front wall 252. A semipermeable membrane 247 is fixed to the rear wall 251 to cover a communication port 224 formed in the rear wall 251. A surface of the semipermeable membrane 247 facing the second section 262 (front surface) faces forward. The second section 262 hence has a larger volume than the volume of the second section 162 of the embodiment.

In this first modification, the predetermined position P1 may be below the semipermeable membrane 247 as in the embodiment (see FIG. 3). Alternatively, the predetermined position P1 may be at the same level as the semipermeable membrane 247. That is, in the example of FIG. 3, the predetermined position P1 may be at a position between upper and lower edges of the semipermeable membrane 247 in the up-down direction 7.

<Second Modification>

In the embodiment, the semipermeable membrane 147 is provided at the second section 162 of the storage chamber 121 in the tank 103. However, the semipermeable membrane 147 may be provided at the first section 161 instead of the second section 162.

Figure 4:
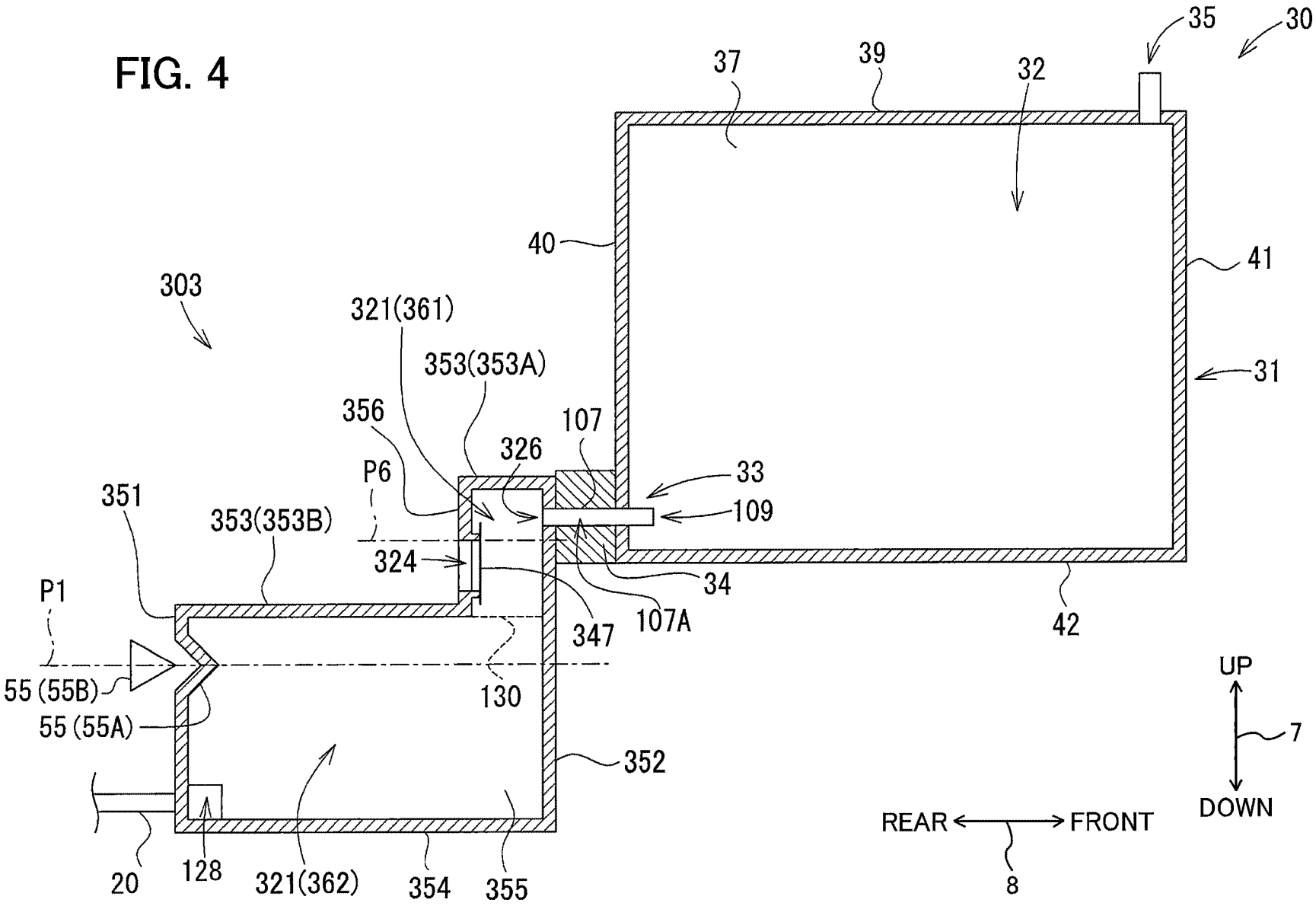
FIG. 4 is a vertical cross-sectional view schematically illustrating a state in which a cartridge and a tank according to a second modification to the embodiment are connected to each other.

Specifically, FIG. 4 depicts a tank 303 according to a second modification to the embodiment. This tank 303 of the second modification defines a storage chamber 321 therein. The storage chamber 321 includes a first section 361, and a second section 362 below the first section 361. The first section 361 is defined by an upper wall 353 (first upper wall 353A), a step wall 356, a front wall 352 and a pair of side walls 355. The second section 362 is defined by a second upper wall 353B of the upper wall 353, a rear wall 351, a lower wall 354, the front wall 352 and the pair of side walls 355. The first section 361 is in communication with the internal space 107A of the connecting pipe 107 through an inlet port 326 formed in the front wall 352. A semipermeable membrane 347 is fixed to the step wall 356 defining the first section 361 to close a communication port 324 formed in the step wall 356. The semipermeable membrane 347 has a front surface facing the first section 361 of the storage chamber 321.

<Third Modification>

In the embodiment, the liquid-level sensor 55 is an optical sensor using the prism 55A. However, other well-known configurations may be available to detect the level of ink stored in the storage chamber 121 of the tank 103.

For example, a sensor arm having a detection portion may be disposed in the storage chamber 121. In this case, when the ink level in the storage chamber 121 reaches the predetermined position P1 or below, the sensor arm is pivoted to move the position of the detection portion. Whether the ink level is equal to or lower than the predetermined position P1 may be determined based on whether an optical sensor detects the detection part of the sensor arm.

Alternatively, instead of the liquid-level sensor 55, electrode bars inserted in the storage chamber 121 may be used. In this case, two electrode bars may be mounted on a substrate (not illustrated) and disposed in the storage chamber 121. A lower end of one of the two electrode bars is located slightly higher than the predetermined position P1, while a lower end of the other electrode bar is arranged below the predetermined position P1. The control board of the multifunction peripheral 10 may determine whether the level of the ink stored in the storage chamber 121 is equal to or lower than the predetermined position P1 based on whether a current flows between the two electrode bars through the ink.

<Fourth Modification>

The shapes of the ink cartridge 30 and the tank 103 are not limited to those of the described embodiment.

Figure 5:
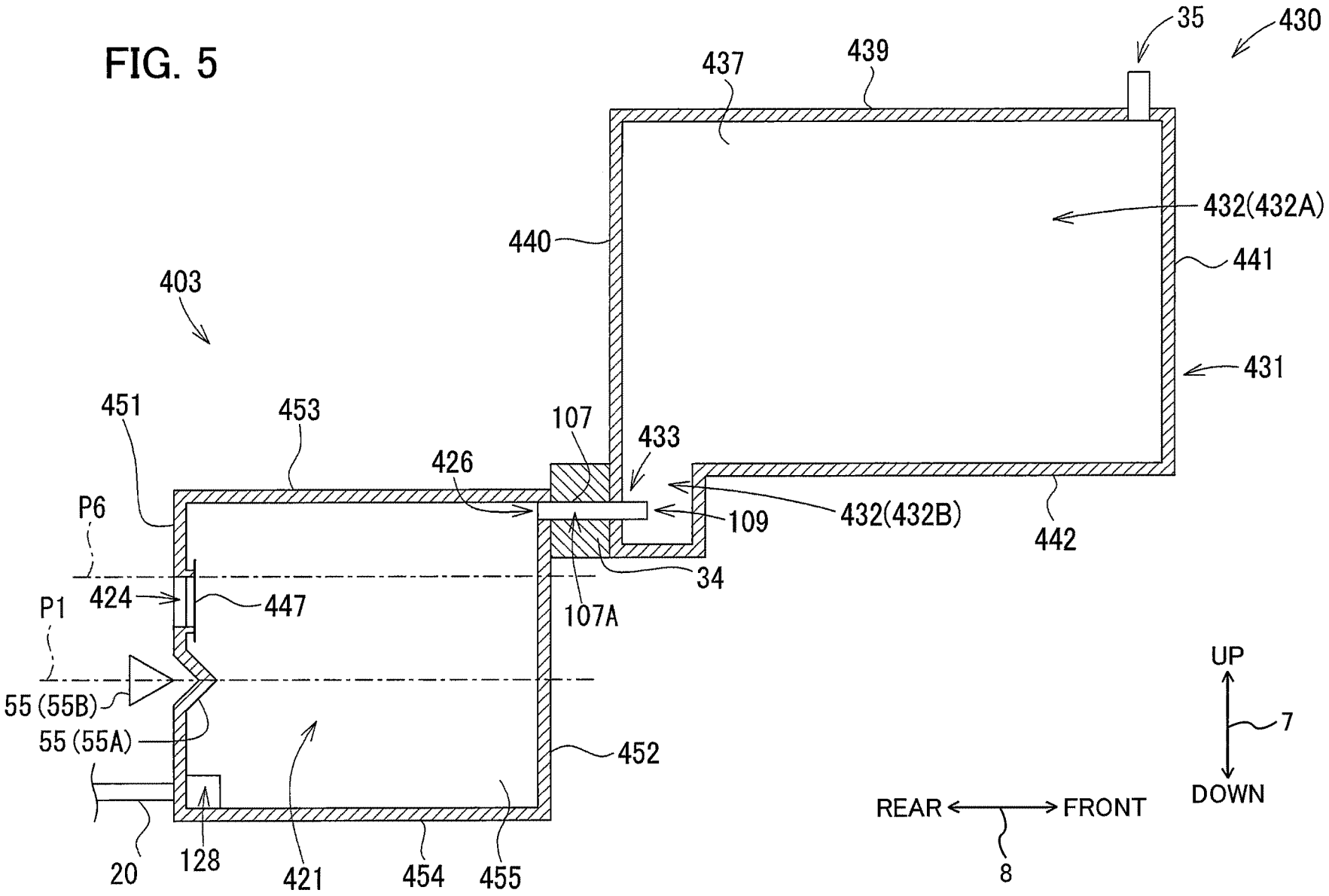
FIG. 5 is a vertical cross-sectional view schematically illustrating a state in which a cartridge and a tank according to a fourth modification to the embodiment are connected to each other.

FIG. 5 depicts an ink cartridge 430 and a tank 403 according to a fourth modification to the embodiment. The ink cartridge 430 of the fourth modification includes a housing 431 defining therein a storage chamber 432. The housing 431 includes an upper wall 439, a front wall 441, a rear wall 440, a lower wall 442 and a pair of side walls 437. The storage chamber 432 is configured of two sections: an upper section 432A and a lower section 432B positioned below the upper section 432A. The lower section 432B has a horizontal cross-sectional area smaller than that of the upper section 432A. The lower section 432B is provided with the ink supply portion 34. An outlet port 433 is formed in the front wall 440 to receive the connecting pipe 107 therein.

The tank 403 of the fourth modification has a simple rectangular parallelepiped shape, unlike the tank 103 of the embodiment. The tank 403 thus defines a single storage chamber 421 therein that is defined by an upper wall 453, a front wall 452, a rear wall 451, a lower wall 454 and a pair of side walls 455. The storage chamber 421 is in communication with the internal space 107A of the connecting pipe 107 through an inlet port 426 formed in the front wall 452. A communication port 424 is formed in the rear wall 451. A semipermeable membrane 447 is provided to cover the communication port 424. The semipermeable membrane 447 has a front surface facing the storage chamber 421, as in the first modification.

<Fifth Modification>

In the embodiment described above, the ink cartridge 30 is connected to the connecting pipe 107 in the front-rear direction 8. Further, the ink cartridge 30 and the tank 103 connected to each other do not overlap each other when viewed in the up-down direction 7. However, the ink cartridge 30 may be connected to the connecting pipe 107 in a direction different from the front-rear direction 8. Also, the ink cartridge 30 and the tank 103 connected to each other may overlap each other when viewed in the up-down direction 7.

Figure 6:
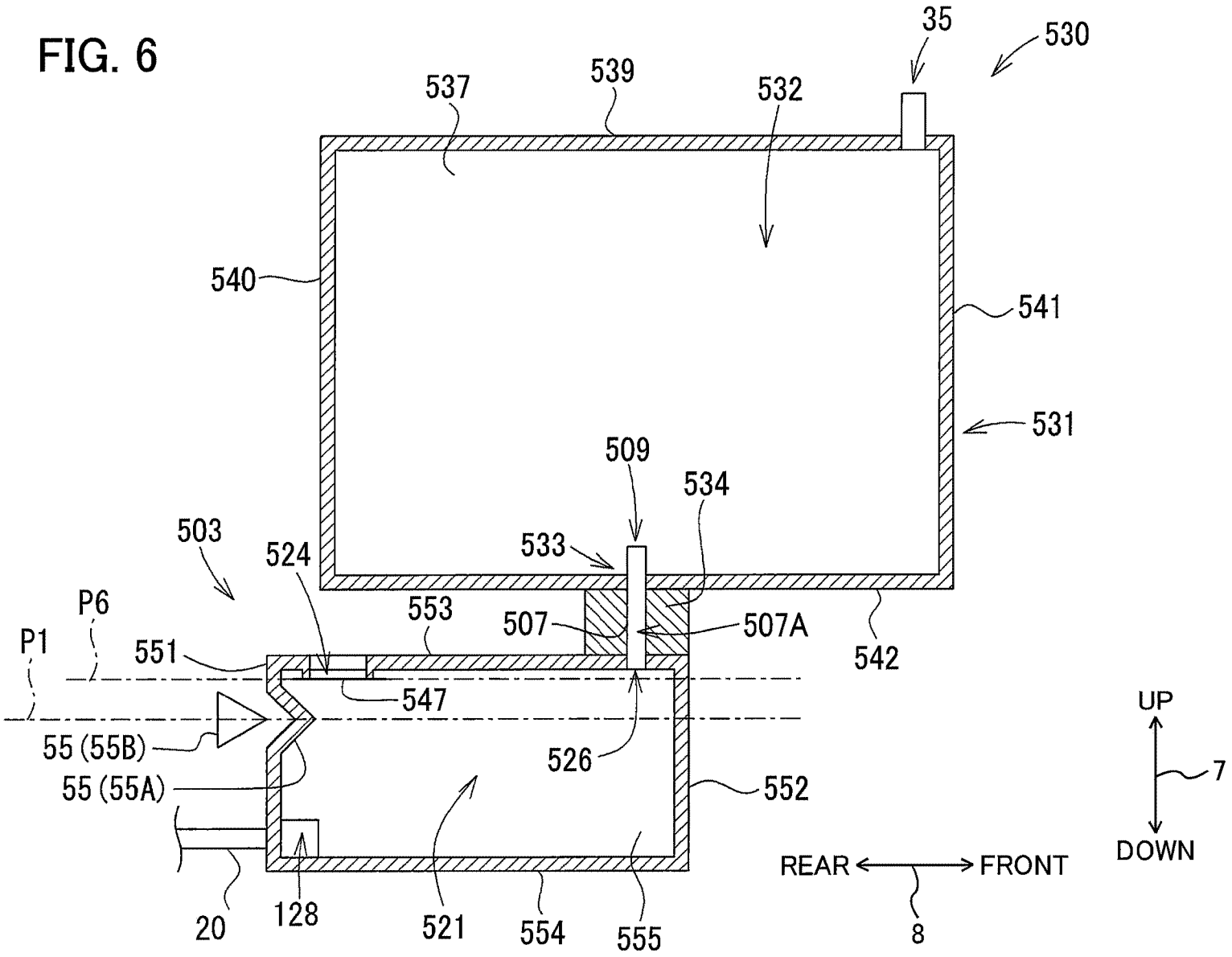
FIG. 6 is a vertical cross-sectional view schematically illustrating a state in which a cartridge and a tank according to a fifth modification to the embodiment are connected to each other.

FIG. 6 depicts an ink cartridge 530 and a tank 503 according to a fifth modification to the embodiment. The ink cartridge 530 is connectable to a connecting pipe 507 of the tank 503 in the up-down direction 7. That is, the connecting pipe 507 of the tank 503 extends in the up-down direction 7 in the fifth modification.

Specifically, the ink cartridge 530 includes a housing 531 and an ink supply portion 534 provided at a lower wall 542 of the housing 531. The housing 531 includes a front wall 541, an upper wall 539, a rear wall 540, the lower wall 542 and a pair of side walls 537. The housing 531 defines therein a storage chamber 532 therein. An outlet port 533 is also formed in the lower wall 542 to receive the connecting pipe 507 therein.

The tank 503 defines a storage chamber 521 therein. The tank 503 includes an upper wall 553, a rear wall 551, a lower wall 554, a front wall 552, and a pair of side walls 455. A communication port 524 is formed in the upper wall 553 and a semipermeable membrane 547 covers the communication port 524. Hence, a lower surface of the communication port 524 faces the storage chamber 521, i.e., faces downward, as in the embodiment. The connecting pipe 507 is provided at the upper wall 553 to extend in the up-down direction 7. The storage chamber 521 is in communication with an internal space 507A of the connecting pipe 507 through an inlet port 526 formed in the upper wall 553. The connecting pipe 507 has an upper end formed with an opening 509.

In a state where the ink cartridge 530 is connected to the tank 503, the connecting pipe 507 is received in the outlet port 533 so that the storage chamber 532 of the ink cartridge 530 is in communication with the internal space 507A of the connecting pipe 507 through the opening 509 of the connecting pipe 507.

In the state where the ink cartridge 530 is connected to the tank 503, the ink cartridge 530 (storage chamber 532) and tank 503 (storage chamber 521) overlap with each other as viewed in the up-down direction 7. That is, the ink cartridge 530 and the tank 503 connected to each other are aligned with each other, at least partially, in the up-down direction 7.

<Other Variations>

In the embodiment, the communication port 35 is formed in the upper wall 39. However, the communication port 35 may be formed in a wall other than the upper wall 39. For example, the communication port 35 may be formed at the front wall 41.

In the embodiment, ink serves as an example of liquid, and the recording portion 24 is described as an example of a consuming device of the liquid supplying system of the disclosure. However, the liquid supplying system of the present disclosure may also be embodied, for example, as a device with a roller for applying a pretreatment liquid onto a recording sheet prior to ink during an image-recording operation. In this device, the pretreatment liquid may serve as the liquid and the roller serves as the consuming device.

<Remarks>

The multifunction peripheral 10 is an example of a liquid supplying system. The ink cartridges 30, 430 are an example of a cartridge. The ink is an example of liquid. The tanks 103, 203, 303, 403 are an example of a tank. The storage chambers 32, 432 are an example of a first storage chamber. The communication port 35 is an example of a first air communication port. The storage chambers 121, 221, 321, 421 are an example of a second storage chamber. The inlet ports 126, 226, 326, 426 are an example of an inlet port. The outlet port 128 is an example of an outlet port. The communication ports 124, 224, 324, 424 are an example of a second air communication port. The semipermeable membranes 147, 247, 347, 447 are an example of a semipermeable membrane.

What is claimed is:

1. A liquid supplying system comprising:

a cartridge comprising:

a first storage chamber configured to store therein a liquid; and a first air communication port allowing the first storage chamber to communicate with an atmosphere; and a tank to which the cartridge is connectable, the tank comprising:

a second storage chamber configured to store therein the liquid;

an inlet port through which the liquid stored in the first storage chamber of the cartridge connected to the tank is introduced into the second storage chamber;

an outlet port through which the liquid stored in the second storage chamber is discharged;

a second air communication port allowing the second storage chamber to communicate with the atmosphere; and a semipermeable membrane provided to cover the second air communication port and allowing air to pass therethrough, the semipermeable membrane being positioned below the inlet port.

2. The liquid supplying system according to claim 1, wherein the semipermeable membrane has a surface facing the second storage chamber, the second storage chamber being prevented from communicating with the atmosphere in a state where an entirety of the surface of the semipermeable membrane is immersed in the liquid stored in the second storage chamber.

3. The liquid supplying system according to claim 2, wherein the surface of the semipermeable membrane faces downward.

4. The liquid supplying system according to claim 1, further comprising a detector configured to detect whether a level of the liquid stored in the second storage chamber reaches a predetermined position in a vertical direction.

5. The liquid supplying system according to claim 4, wherein the predetermined position is positioned below the semipermeable membrane.

6. The liquid supplying system according to claim 1, wherein the second storage chamber comprises:

a first section including the inlet port; and a second section positioned below the first section and having a horizontal cross-sectional area greater than a horizontal cross-sectional area of the first section, the second section including the outlet port.

7. The liquid supplying system according to claim 6, wherein the semipermeable membrane is provided in the second section.

8. The liquid supplying system according to claim 6, wherein the semipermeable membrane is provided in the first section.

9. The liquid supplying system according to claim 1, wherein the cartridge is connectable to the tank in a horizontal direction.

10. The liquid supplying system according to claim 1, wherein the cartridge is positioned offset from the tank in a vertical direction in a state where the cartridge is connected to the tank.

* * * * *